US006735886B2

(12) United States Patent
Kang et al.

(10) Patent No.: US 6,735,886 B2
(45) Date of Patent: May 18, 2004

(54) SOCCER SHOES HAVING AN IMPROVED STRUCTURE CAPABLE OF ALLOWING A USER TO KICK A BALL FARTHER

(75) Inventors: Sug Kyu Kang, Kayang-dong 249-3, Kang seo-ku, Seoul (KR), 157-200; Moo Young Lee, Dang-dong 782-6, Kyunggi-do (KR), 435-010

(73) Assignees: Markpro Co., Ltd (KR); Sug Kyu Kang (KR); Moo Young Lee (KR)

( * ) Notice: Subject to any disclaimer, the term of this patent is extended or adjusted under 35 U.S.C. 154(b) by 310 days.

(21) Appl. No.: 09/963,122

(22) Filed: Sep. 24, 2001

(65) Prior Publication Data

US 2002/0004998 A1 Jan. 17, 2002

Related U.S. Application Data

(63) Continuation-in-part of application No. 09/535,609, filed on Mar. 27, 2000, now abandoned.

(30) Foreign Application Priority Data

Jun. 17, 1999 (KR) ..... 1999-22737

(51) Int. Cl.[7] ..... A43B 5/02; A43B 5/00; A43B 23/07

(52) U.S. Cl. ..... 36/128; 36/114; 36/72 R; 36/55

(58) Field of Search ..... 36/93, 96, 98, 36/113, 114, 115, 128, 133, 71, 72 R, 45, 47, 55, 70

(56) References Cited

U.S. PATENT DOCUMENTS

| | | | | |
|---|---|---|---|---|
| 1,537,778 A | | 5/1925 | Nvhagen | |
| 1,577,791 A | | 3/1926 | Dreschler | |
| 3,101,559 A | | 8/1963 | Smith | |
| 4,430,811 A | | 2/1984 | Okada | |
| 5,216,827 A | | 6/1993 | Cohen | |
| 5,505,011 A | | 4/1996 | Bleimhofer | |
| 5,513,450 A | | 5/1996 | Aviles Palazzo | |
| 5,678,326 A | | 10/1997 | Pavelescu | |
| 5,694,703 A | * | 12/1997 | Diaz | 36/7.1 R |
| 5,738,937 A | | 4/1998 | Bavchar | |
| 5,918,382 A | | 7/1999 | Haderlein et al. | |
| 6,079,128 A | * | 6/2000 | Hoshizaki et al. | 36/115 |
| 6,168,172 B1 | * | 1/2001 | Meibock et al. | 36/115 |

* cited by examiner

*Primary Examiner*—Anthony D. Stashick
(74) *Attorney, Agent, or Firm*—Harness, Dickey & Pierce, P.L.C.

(57) ABSTRACT

Disclosed is a soccer shoe having a structure, which allows a user to kick a ball farther, lessens the pain in a kicker's feet, and allows the shoe to maintain its shape after kicking a ball or even after being used for relatively long time. The soccer shoe has a sole member and an upper fixed to the sole member. The upper has: an inner coat fitly surrounding and being in contact with the heel, the inside foot, the outside foot, the toe, and the instep portions of the user, when the user puts on the soccer shoe, the inner coat being made from cloth; a sponge layer being adhered to an outer surface of the inner coat, the sponge layer being made from compressed sponge; a rubber layer being adhered to an outer surface of the sponge layer, the rubber layer being made from natural rubber, the rubber layer having a thickness between 0.38 mm and 0.42 mm, the rubber layer being so formed as to cover only the toe portion of the user, the rubber layer having a plurality of pores; and an outer coat being adhered to an outer surface of the rubber layer, the outer coat constituting an outermost layer of the soccer shoe, so as to come into contact with the ball when the user kicks the ball, the outer coat being made from leather.

11 Claims, 3 Drawing Sheets

SOCCER SHOES HAVING AN IMPROVED STRUCTURE CAPABLE OF ALLOWING A USER TO KICK A BALL FARTHER

CROSS REFERENCE TO RELATED APPLICATIONS

The application is a continuation in part application of U.S. application Ser. No. 09/535,609, filed on Mar. 27, 2000, abandoned.

BACKGROUND OF THE INVENTION

1. Field of the Invention

The present invention relates to a soccer shoe having an improved structure, which allows a user to kick a ball farther, lessens the pain in a kicker's feet, and allows the shoe to maintain its shape after kicking a ball or even after being used for relatively long time.

2. Description of the Related Art

Soccer shoes are footwear, which a user puts on when the user play soccer or kicks a soccer ball.

In kicking a soccer ball with a soccer shoe, it is necessary to impact different parts of the ball with different portions of the shoe in order to make the ball move in different directions and at different velocities. For example, if one desires to kick the ball low and hard, i.e. at a high velocity, one must strike the ball with the front upper portion of the shoe, otherwise known in the industry as the instep, Likewise, if one desires to make a short pass to a teammate keeping the ball on the ground, one must strike the middle of the ball with the inner side surface of the shoe.

Further, in order to make the ball curve to either the right or left when one strikes the ball with one's foot, it is desirable to strike a preselected portion of the ball with a preselected portion of the foot. For example, if a right footed kicker desires to make the ball curve from right to left, he or she may strike the exterior of the ball with the inside toe portion of the right foot. Conversely, if the right footed kicker desires to make the ball curve outwardly, i.e. from left to right, the kicker may strike the left side of the ball with the outer toe portion of his or her right foot.

As can be inferred from the above description, an impact applied to the user's foot, a repulsive force between the shoe and the ball, and a flying distance of the ball are different according to the material and the structure of the upper of a soccer shoe, when the user wearing the soccer shoe kicks the ball.

Especially, when the user wants to give a long kick or shoot a goal, the user usually does an instep kick, which uses the instep portion in kicking, and a stronger repulsive force is required in the instep portion of the upper of the shoe, in order to increase the flying distance and speed of the kicked ball. Moreover, it can be generally said that the repulsive force is required to be increased for the entire portion of a soccer shoe.

Each upper of various conventional soccer shoes usually consists of three layers, an outer coat, a sponge layer, and an inner coat. However, in the upper of the conventional soccer shoes, the sponge layer mainly maintains the form of the shoe and provides the repulsive force, which relatively has a limitation in increasing the repulsive force between the conventional shoe and the ball.

In addition, an impact applied to a portion of the user's foot, especially to the user's toe, which is relatively sensitive to the pain, can make the user feel a pain in the portion of the user's foot, by which the user kicks the ball. Moreover, this pain can disturb the user in kicking the ball strongly for the concern for the pain. However, the three layers of the conventional shoes cannot perform a sufficient function in preventing or reducing the pain.

Moreover, the sponge layer also has a limitation in constantly maintaining the form of the soccer shoe after being deformed or after being used for long time In spite of these problems of the conventional soccer shoes, there has been found no technology or art in order to reduce the pain as described above and increase the repulsive force by the soccer shoe in the knowledge of the present applicant.

SUMMARY OF THE INVENTION

Accordingly, the present invention has been made in an effort to solve the problems occurring in the related art, and it is an object of the present invention to provide a soccer shoe having a structure, which allows a user to kick a ball farther, lessens the pain in a kicker's feet, and allows the shoe to maintain its shape after kicking a ball or even after being used for relatively long time.

Also, it is another object of the present invention to provide a soccer shoe having a structure, which enable not only the user to put on the shoe more fitly, so as to increase the flying distance of the ball, but also the adhesive force between the layers to be increased, so as to improve the quality of the shoe.

In accordance with one aspect, the present invention provides a soccer shoe capable of allowing a user to kick a ball farther, the soccer shoe comprising: a sole member; and an upper fixed to the sole member, the upper surrounding at least heel, inside foot, outside foot, toe, and instep portions of the user, when the user puts on the soccer shoe, wherein the upper comprises: an inner coat fitly surrounding and being in contact with the heel, the inside foot, the outside foot, the toe, and the instep portions of the user, when the user puts on the soccer shoe; an outer coat constituting an outermost layer of the soccer shoe, so as to come into contact with the ball when the user kicks the ball; and a sponge layer and a rubber layer inserted between the inner coat and the outer coat, the sponge layer and the rubber layer being adhered to each other, the inner coat being adhered to a first one of the sponge layer and the rubber layer, the outer coat being adhered to a second one of the sponge layer and the rubber layer.

Preferably, the inner coat, the sponge layer, and the rubber layer may respectively be made from cloth, compressed sponge, and natural rubber, while the outer coat may be made from such material as leather, polyurethane, and vinyl resin.

More preferably, the rubber layer has a thickness between 0.38 mm and 0.42 mm, and is so formed as to cover only the toe portion of the user. The rubber layer may have a plurality of pores.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
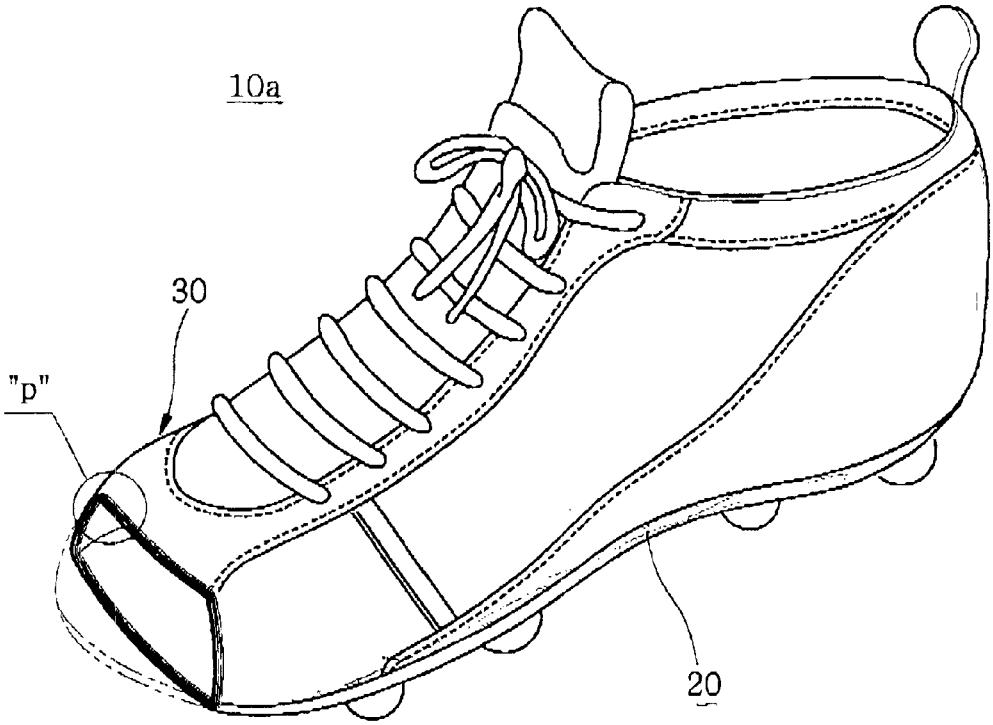
FIG. 1 is a perspective view of a soccer shoe capable of allowing a user to kick a ball farther, according to an embodiment of the present invention.

The above and other objects, characteristics, and advantages of the present invention will be apparent from the following description along with the accompanying drawings. In the following description, the same elements will be numbered by the same reference numerals throughout the drawings.

Figure 2:
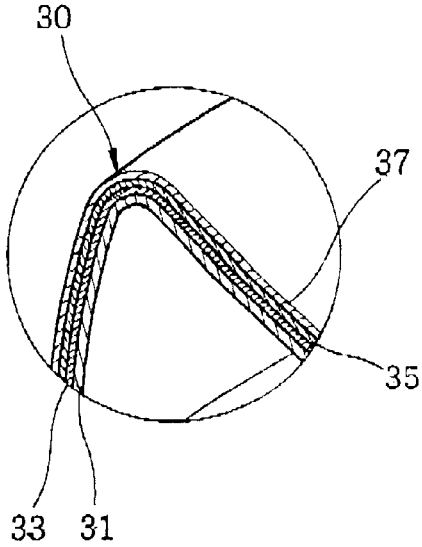
FIG. 2 is an enlarged view of "P" part of FIG. 1.

FIG. 1 is a perspective view of a soccer shoe capable of allowing a user to kick a ball farther, according to an embodiment of the present invention and FIG. 2 is an enlarged view of "P" part of FIG. 1.

The soccer shoe 10*a* includes a sole member 20 and an upper 30 fixed to the sole member 20. When the user puts on the soccer shoe 10*a*, the upper 30 surrounds at least heel, inside foot, outside foot, toe, and instep portions of the user, Meanwhile, the upper 30 includes an inner coat 31, a sponge layer 33, a rubber layer 35, and an outer coat 37.

The inner coat 31 fitly surrounds and is in contact with the heel, the inside foot, the outside foot, the toe, and the instep portions of the user, when the user puts on the soccer shoe 10*a*. It is preferred that the inner coat 31 is made from cloth The sponge layer 33 is adhered to an outer surface of the inner coat 31. Also, it is preferred that the sponge layer is made from compressed sponge.

The rubber layer 35 is adhered to an outer surface of the sponge layer 33. It is preferred that the rubber layer 35 is made from natural rubber. More preferably, the rubber layer 35 may have a thickness between 0.10 mm and 0.50 mm, so that the rubber layer 35 can reduce the impact transferred from the ball and increase a repulsive force applied to the ball without deforming the shape of the shoe 10*a* and without excessively hardening the upper 30 of the shoe 10*a*, when the user putting on the shoe kicks a ball by the toe portion.

In the case where the thickness is too large, the shoe 10*a* may be too hard and too heavy to be used as a soccer shoe. That is, when the thickness of the rubber layer 35 is too large, the rubber layer 35 may be so stiff as to disturb the movement of the user's foot while the user runs or kicks a ball. In contrast, when the thickness is too small, the rubber layer cannot play its role of reducing the impact and increasing the repulsive force.

Moreover, the rubber layer 35 may be so formed as to cover only the toe portion of the user. In this case, the toe portion of the user, which is a sensitive portion of human body to the pain, can be protected well from the impact due to the kicking. Of course, the user can kick the ball much stronger and much farther as well, in the case of kicking by the toe, which is called as the toe kick in soccer.

In the case where the rubber layer 35 is so formed as to cover the toe and the instep portions of the user, the above-described effect of kicking stronger and farther can be taken more remarkably. That is, the user of the soccer shoe 10*a* usually uses the instep portion with an upper part of the toe portion, when the user wants to kick far or with a high speed, for example, when the user gives a long kick or shoots a goal. Therefore, the rubber layer 35 covering the toe and the instep portions enable the user of the shoe 10*a* to give a longer kick and shoot a faster goal.

Figure 5:
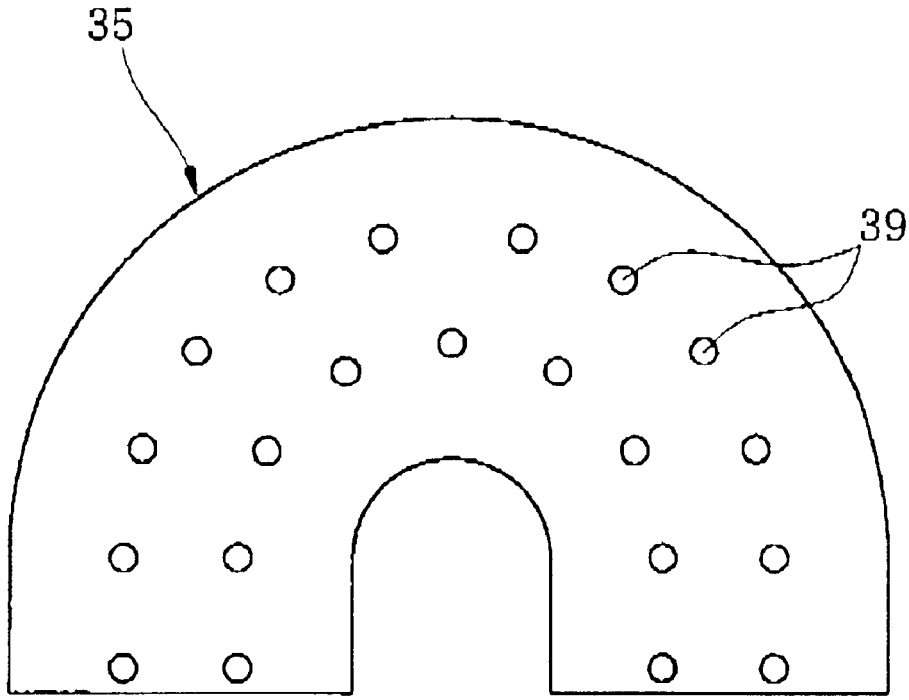
FIG. 5 is a rubber layer having a plurality of pores, which is employed in the soccer shoe of the present invention.

Further, as shown in FIG. 5, the rubber layer 35 may have a plurality of pores 39, which enable air in the soccer shoe 10*a* to escape out of the shoe 10*a*. In other words, although only the rubber layer 35 without the pores 39 is not ventilative, differently from the inner coat 31, the sponge layer 33, and the outer coat 37, which are made from ventilative materials such as cloth, sponge, and leather, the pores 39 provides the rubber layer 35 with air permeability. In addition, the pores 39 enable air, which may remain between the layers 31, 33, 35, and 37 after the layers 31, 33, 35, and 37 are adhered to each other, to be discharged.

The outer coat 37 is adhered to an outer surface of the rubber layer 35. The outer coat 37 constitutes an outermost layer of the soccer shoe 10*a*, so as to come into contact with the ball when the user kicks the ball. Preferably, the outer coat is made from such material as leather, Polyurethane, and vinyl resin.

Figure 3:
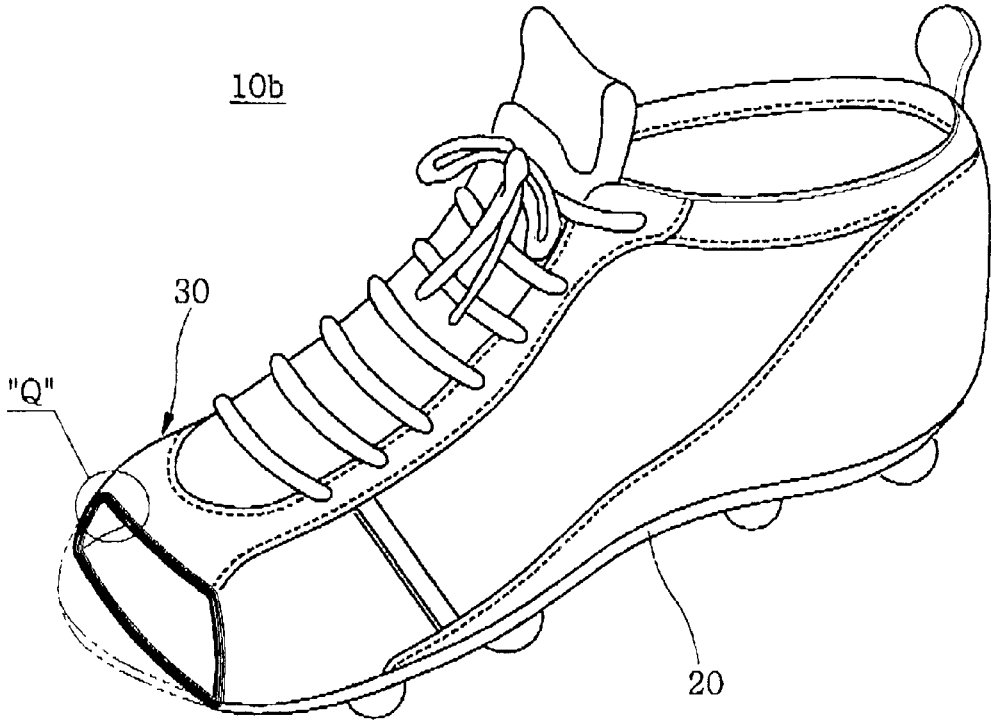
FIG. 3 is a perspective view of a soccer shoe capable of allowing a user to kick a ball farther, according to another embodiment of the present invention.
Figure 4:
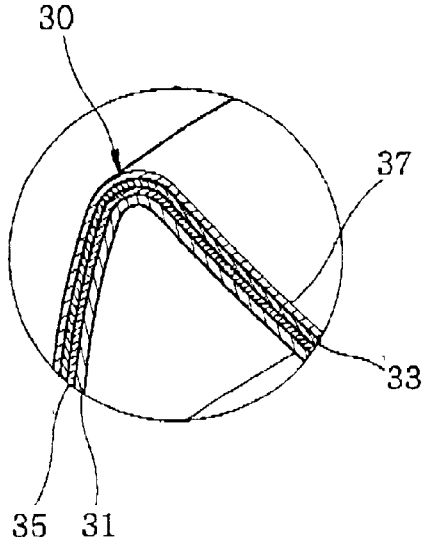
FIG. 4 is an enlarged view of "Q" part of FIG. 3.

FIG. 3 is a perspective view of a soccer shoe capable of allowing a user to kick a ball farther, according to another embodiment of the present invention and FIG. 4 is an enlarged view of "Q" part of FIG. 3.

The soccer shoe 10*b* according to the present embodiment has the same construction as that of the soccer shoe according to the previous embodiment, except for the following construction. That is, in the soccer shoe 10*b*, the rubber layer 35 is adhered to an outer surface of the inner coat 31, the sponge layer 33 is adhered to an outer surface of the rubber layer 35, and the outer coat 37 is adhered to an outer surface of the sponge layer 33.

Hereinafter, described will be a function and an effect of a soccer shoe capable of allowing a user to kick a ball farther, according to the present invention.

When the user kicks a ball, the outer coat 37 comes into collision with the ball. At that time, the impact between the ball and the outer coat 37 is largely absorbed and reduced by the sponge layer 33 and the rubber layer 35, and then transferred through the inner coat 31 to the user's foot. Therefore, the user hardly feels pain in the foot, so that he can kick the ball more strongly even without any concern for the pain.

In the meantime, a repulsive force applied to the ball kicked by the shoe is further increased due to the repulsive characteristic of the rubber layer 35 in addition to that of an interior inflatable bladder (not shown) made from rubber, which is contained in the soccer ball. In result, the ball can fly farther by the shoe of the present invention, in comparison with the case of being kicked by the conventional soccer shoe Moreover, the rubber layer 35 functions to maintain and restore the shape of the shoe 10*a* and 10*b* after the shoe is deformed due to a kicking or after being used for relatively long time, in combination with the sponge layer 33. Especially, owing to the proper thickness of the rubber layer 35 between 0.38 mm and 0.42 mm, the shape of the shoe 10*a* and 10*b* can be prevented from being deformed after kicking, without an excessive hardening of the upper 30, which may disturb the movement of the user's foot while the user runs or kicks a ball.

Also, the pores 39 employed in the shoe of the present invention enable air in the soccer shoe 10*a* to escape out of the shoe 10*a*. Since the rubber, which is a material for the rubber layer 35, is not ventilative, while the inner coat 31, the sponge layer 33, and the outer coat 37 are made from ventilative materials such as cloth, sponge, and leather, the pores 39 formed at the rubber layer 35 enable the air in the shoe 10*a* and 10*b* to be discharged through the layers 31, 33, 35, and 37 out of the shoe. In result, not only the user can put on the shoe more fitly in usual time, but also the inner coat 31 of the shoe can be more tightly fitted around the user's foot when the user kicks a ball, thereby increasing the repulsive force between the shoe and the ball so as to increase the flying distance of the ball.

In addition, the pores 39 enable air, which may remain between the layers 31, 33, 35, and 37 after the layers 31, 33, 35, and 37 are adhered to each other, to be discharged. Therefore, the adhesive force between the layers 31, 33, 35, and 37 can be increased, so that the quality of the shoe can be improved.

In the shoe according to the present invention as described above, when the user kicks a ball, the impact between the ball and the outer coat is largely absorbed and reduced by the sponge layer and the rubber layer. Therefore, the user hardly feels pain in the foot, so that he can kick the ball more strongly even without any concern for the pain.

Further, in the shoe of the present invention, a repulsive force between the shoe and the ball is further increased due to the repulsive characteristics of the rubber layer and the bladder contained in the soccer ball, so that the ball can be kicked farther.

Moreover, in the shoe of the present invention, the shape of the shoe can be prevented from being deformed after kicking, without disturbing the movement of the user's foot while the user runs or kicks a ball.

Also, due to the pores of the rubber layer, not only the user can put on the shoe more fitly, but also the flying distance of the ball can be increased. In addition, the pores enable the adhesive force between the layers to be increased, so as to improve the quality of the shoe.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. In a soccer shoe having a sole member, and an upper fixed to the sole member to surround the heel, medial side, lateral side, forepart, and instep of the foot of a user, said upper comprising:

a flexible outer coat thin enough to be used for an ordinary soccer shoe;

a thin rubber layer laid adhering to the inside of said outer coat;

a sponge layer laid adhering to the inside of said rubber layer; and an inner coat laid adhering to the inside of said sponge layer, said inner coat being made of a cloth, wherein said rubber layer is thin enough not to dull the user's foot touch to a soccer ball while providing an elasticity both to contribute to a repulsive force applied to the soccer ball when colliding with said soccer shoe and to alleviate the pain of the foot caused by kicking said ball.

2. An upper of said soccer shoe as defined in claim 1, wherein said rubber layer has a thickness of 0.10 mm to 0.50 mm.

3. An upper of said soccer shoe as defined in claim 2, wherein said rubber layer has a plurality of pores for providing ventilation.

4. An upper of said soccer shoe as defined in claim 3, wherein said rubber layer is so formed as to cover the forepart of the foot or to be laid in the vamp of said soccer shoe.

5. An upper of said soccer shoe as defined in claim 4, wherein said outer layer is made of a leather, polyurethane, or vinyl resin.

6. An upper of said soccer shoe as defined in claim 5, wherein said sponge layer is made of a compressed sponge.

7. In a soccer shoe having a sole member, and an upper fixed to the sole member to surround the heel, medial side, lateral side, forepart, and instep of the foot of a user, said upper comprising:

a flexible outer coat thin enough to be used for an ordinary soccer shoe;

a sponge layer laid adhering to the inside of said outer coat;

a thin rubber layer laid adhering to the inside of said sponge layer; and an inner coat laid adhering to the inside of said thin rubber layer, said inner coat being made of a cloth, wherein said rubber layer is thin enough not to dull the user's foot touch to a soccer ball with securing an elasticity both to contribute to a repulsive force applied to the soccer ball when colliding with said soccer shoe and to alleviate the pain of the foot caused by kicking said ball.

8. A soccer shoe comprising:

a sole member with cleats depending therefrom;

a flexible upper sufficiently thin to be used for striking a soccer ball during a game of soccer, said upper including:

a. an outer layer;

b. an inner layer;

c. a sponge layer disposed between the outer and inner layers; and d. a thin rubber layer disposed between the outer and inner layers, said rubber layer being sufficiently thin to not dull a user's feel of the soccer ball when striking it with his foot while providing sufficient elasticity to provide a repulsive force against the soccer ball when striking it with the shoe, and said rubber layer being sufficiently thick to minimize pain to the foot caused by kicking the soccer ball.

9. The soccer shoe of claim 8 wherein said rubber layer covers substantially only a front portion of the shoe.

10. The soccer shoe of claim 8 wherein said rubber layer has a thickness of about 0.10 mm to about 0.50 mm.

11. The soccer shoe of claim 8 wherein said rubber layer has a plurality of pores therein for providing ventilation.

* * * * *